US006431324B2

(12) United States Patent
Tajima et al.

(10) Patent No.: US 6,431,324 B2
(45) Date of Patent: Aug. 13, 2002

(54) CONTROLLER SCHEDULING CONSTANT CURRENT CHARGING OF A RECHARGEABLE POWER SOURCE OF AN ELEVATOR SYSTEM

(75) Inventors: Shinobu Tajima; Hiroshi Araki; Ikuro Suga; Kazuyuki Kobayashi, all of Tokyo (JP)

(73) Assignees: Mitsubishi Denki Kabushiki Kaisha; The Tokyo Electric Power Company, Inc., both of Tokyo (JP)

( * ) Notice: Subject to any disclaimer, the term of this patent is extended or adjusted under 35 U.S.C. 154(b) by 0 days.

(21) Appl. No.: 09/785,233

(22) Filed: Feb. 20, 2001

(30) Foreign Application Priority Data

Feb. 28, 2000 (JP) ..... 2000-052347

(51) Int. Cl.[7] ..... B66B 1/06
(52) U.S. Cl. ..... 187/290; 187/296
(58) Field of Search ..... 187/290, 247, 187/293, 296, 277; 318/375, 376; 307/64, 66; 320/127, 130, 134, 135

(56) References Cited

U.S. PATENT DOCUMENTS 3,585,482 A * 6/1971 Zelina ..... 318/376
4,316,097 A * 2/1982 Reynolds ..... 307/66
4,456,097 A * 6/1984 Salihi ..... 187/29 R
4,554,999 A * 11/1985 Kamike ..... 187/29 R
5,285,029 A * 2/1994 Araki ..... 187/114
5,698,823 A * 12/1997 Tanahashi ..... 187/296
5,712,456 A * 1/1998 McCarthy et al. ..... 187/290
6,121,740 A * 9/2000 Gale et al. ..... 318/376
6,264,005 B1 * 7/2001 Kang et al. ..... 187/290
6,315,081 B1 * 11/2001 Yeo ..... 187/200

FOREIGN PATENT DOCUMENTS

JP 10-67469 3/1998

* cited by examiner

*Primary Examiner*—Jonathan Salata
(74) *Attorney, Agent, or Firm*—Leydig, Voit & Mayer, Ltd.

(57) ABSTRACT

A controller of an elevator for reducing the number of execution times of uniform charging of a power accumulating device and having higher energy saving effects. The controller has a converter, an inverter, a power accumulating device arranged between DC buses, a charging-discharging control circuit for controlling charging and discharging operations of the power accumulating device, and a charging-discharging state measuring device for measuring at least one of temperature, charging and discharging currents, and charging and discharging voltages of the power accumulating device. The charging-discharging control circuit sets the execution of uniform charging of the power accumulating device on the basis of an output of the charging-discharging state measuring device, and executes only the required uniform charging. Thus, an elevator with the power accumulating device having larger energy saving effects is constructed.

7 Claims, 13 Drawing Sheets

FIG. 2

T1

| CHARGING CURRENT | JUDGING VOLTAGE |
|---|---|
| I1 | V1 |
| I2 | V2 |

FIG. 4

T1a

T1b

| CHARGING CURRENT | JUDGING VOLTAGE |
|---|---|
| I1 | V1 |
| I2 | V2 |
| • | • |
| • | • |
| • | • |
| • | • |
| • | • |

FIG. 6

T2

| CHARGING CURRENT | CHANGING AMOUNT OF JUDGING VOLTAGE |
|---|---|
| I1 | DV1 |
| I2 | DV2 |

CONTROLLER SCHEDULING CONSTANT CURRENT CHARGING OF A RECHARGEABLE POWER SOURCE OF AN ELEVATOR SYSTEM

BACKGROUND OF THE INVENTION

1. Field of the Invention

This invention relates to a controller of an elevator of an energy saving type to which a secondary battery is applied.

2. Description of the Related Art

FIG. 11 is a view showing the basic construction of a controller for controlling the operation of an elevator by applying a conventional secondary battery thereto.

In FIG. 11, reference numerals 1 and 2 respectively designate a three-phase AC power source and a converter constructed by a diode, etc. and converting AC power outputted from the three-phase AC power source 1 to DC power. The DC power converted by the converter 2 is supplied to a DC bus 3. The operation of an inverter 4 is controlled by a speed controller for controlling a speed position of the elevator and described later. A direct current supplied through the DC bus 3 is converted to an alternating current of predetermined desirable variable voltage and variable frequency and an AC motor 5 is driven so that a hoisting machine 6 of the elevator directly connected to the AC motor 5 is rotated. Thus, a rope 7 wound around the hoisting machine 6 controls elevating and lowering operations of a car 8 and a counterweight 9 connected to both ends of this rope 7 and passengers within the car 8 are moved to a predetermined stage floor.

Here, weights of the car 8 and the counterweight 9 are designed such that these weights are approximately equal to each other when passengers half a number limit ride in the car 8. Namely, when the car 8 is elevated and lowered with no load, a power running operation is performed at a lowering time of the car 8 and a regenerative operation is performed at a elevating time of the car 8. Conversely, when the car 8 is lowered in the number limit riding, the regenerative operation is performed at the lowering time of the car 8 and the power running operation is performed at the elevating time of the car 8.

An elevator control circuit 10 is constructed by a microcomputer, etc., and manages and controls an entire operation of the elevator. A power accumulating device 11 is arranged between DC buses 3 and accumulates power at the regenerative operation time of the elevator, and supplies the accumulated power to the inverter 4 together with the converter 2 at the power running operation time. The power accumulating device 11 is constructed by a secondary battery 12 and a DC-DC converter 13 for controlling charging and discharging operations of this secondary battery 12.

Here, the DC-DC converter 13 has a voltage lowering type chopper circuit and a voltage raising type chopper circuit. The voltage lowering type chopper circuit is constructed by a reactor 13*a*, a gate 13*b* for charging current control connected in series to this reactor 13*a*, and a diode 13*c* connected in reverse parallel to a gate 13*d* for discharging current control described later. The voltage raising type chopper circuit is constructed by the reactor 13*a*, the gate 13*d* for discharging current control connected in series to this reactor 13*a*, and a diode 13*e* connected in reverse parallel to the above gate 13*b* for charging current control. Operations of the gate 13*b* for charging current control and the gate 13*d* for discharging current control are controlled by a charging-discharging control circuit 15 on the basis of a measuring value from a charging-discharging state measuring device 14 for measuring charging and discharging states of the power accumulating device 11 and a measuring value from a voltage measuring instrument 18. A current measuring instrument arranged between the secondary battery 12 and the DC-DC converter 13 is used as the charging-discharging state measuring device 14 in this conventional example.

A gate 16 for regenerative current control and a regenerative resistor 17 are arranged between DC buses 3. The voltage measuring instrument 18 measures the voltage of a DC bus 3. A regenerative control circuit 19 is operated on the basis of regenerative control commands from a speed control circuit described later. The gate 16 for regenerative current control is constructed such that an ON pulse width is controlled on the basis of control of the regenerative control circuit 19 when a measuring voltage provided by the voltage measuring instrument 17 is equal to or greater than a predetermined value at the regenerative operation time. Regenerated power is discharged in the regenerative resistor 17 and is converted to thermal energy and is consumed.

An encoder 20 is directly connected to the hoisting machine 6. The speed control circuit 21 controls a position and a speed of the elevator by controlling an output voltage and an output frequency of the inverter 4 on the basis of speed commands and a speed feedback output from the encoder 22 based on commands from the elevator control circuit 10.

An operation of the controller having the above construction will next be explained.

At a power running operation time of the elevator, power is supplied to the inverter 4 from both the three-phase AC power source 1 and the power accumulating device 11. The power accumulating device 11 is constructed by the secondary battery 12 and the DC-DC converter 13, and an operation of this power accumulating device 11 is controlled by the charging-discharging control circuit 15. In general, the number of secondary batteries 12 is reduced as much as possible and an output voltage of each secondary battery 12 is lower than the voltage of the DC bus 3 so as to make the controller compact and cheaply construct the controller. The voltage of the DC bus 3 is basically controlled near a voltage provided by rectifying a three-phase AC of the three-phase AC power source 1. Accordingly, it is necessary to lower the bus voltage of the DC bus 3 at a charging time of the secondary battery 12 and raise the bus voltage of the DC bus 3 at a discharging time of the secondary battery 12. Therefore, the DC-DC converter 13 is adopted. Operations of the gate 13*b* for charging current control and the gate 13*d* for discharging current control in this DC-DC converter 13 are controlled by the charging-discharging control circuit 15.

FIGS. 12 and 13 are flow charts showing controls of the charging-discharging control circuit 15 at its discharging and charging times.

The control of the charging-discharging control circuit 15 at the discharging time shown in FIG. 12 will first be explained.

A current control minor loop, etc. are constructed in voltage control of a control system and the control operation may be more stably performed. However, for simplicity, the control of the charging-discharging control circuit 15 is here explained by a control system using the bus voltage.

First, the bus voltage of the DC bus 3 is measured by the voltage measuring instrument 18 (step S11). The charging-discharging control circuit 15 compares this measuring voltage with a predetermined desirable voltage set value and judges whether the measuring voltage exceeds the voltage set value or not (step S12). If no measuring voltage exceeds the set value, the charging-discharging control circuit 15 next judges whether the measuring value of a discharging current of the secondary battery 12 provided by the charging-discharging state measuring device 14 exceeds a predetermined value or not (step S13).

When the measuring voltage exceeds the set value by these judgments, or when the measuring value of the discharging current of the secondary battery 12 exceeds the predetermined value even if no measuring voltage exceeds the set value, an adjusting time DT is subtracted from the present ON time to shorten an ON pulse width of the gate 13*d* for discharging current control and a new gate ON time is calculated (step S14).

In contrast to this, when it is judged in the above step S13 that no measuring value of the discharging current of the secondary battery 12 provided by the measuring device 14 exceeds the predetermined value, a new gate ON time is calculated by adding the adjusting time DT to the present ON time so as to lengthen the ON pulse width of the gate 13*d* for discharging current control (step S15). Thus, ON control of the gate 13*d* for discharging current control is performed on the basis of the calculated gate ON time, and the calculated gate ON time is stored to a built-in memory as the present ON time (step S16).

Thus more electric current flows from the secondary battery 12 by lengthening the ON pulse width of the gate 13*d* for discharging current control. As a result, supply power is increased and the bus voltage of the DC bus 3 is increased by the power supply. When the power running operation is considered, the elevator requires a power supply and this power is supplied by discharging the secondary battery 12 and power supplied from the three-phase AC power source 1. When the bus voltage is controlled such that this bus voltage is higher than an output voltage of the converter 2 supplied from the three-phase AC power source 1, all power is supplied from the secondary battery 12. However, the controller is designed such that all power is not supplied from the secondary battery 12, but is supplied from the secondary battery 12 and the three-phase AC power source 1 in a suitable ratio so as to cheaply construct the power accumulating device 11.

Namely, in FIG. 12, the measuring value of the discharging current is compared with a supply allotment corresponding current (predetermined value). If this measuring value exceeds the predetermined value, the ON pulse width of the gate 13*d* for discharging current control is lengthened and a supply amount is further increased. In contrast to this, when no measuring value of the discharging current exceeds the predetermined value, the ON pulse width of the gate 13*d* for discharging current control is shortened and the power supply is clipped. Thus, since power supplied from the secondary battery 12 is clipped among power required in the inverter 4, the bus voltage of the DC bus 3 is reduced so that the power supply from the converter 2 is started. These operations are performed for a very short time so that a suitable bus voltage is actually obtained to supply required power of the elevator. Thus, power can be supplied from the secondary battery 12 and the three-phase AC power source 1 in a predetermined desirable ratio.

The control of the charging-discharging control circuit 15 at the charging time shown in FIG. 13 will next be explained.

When there is power regeneration from the AC motor 5, the bus voltage of the DC bus 3 is increased by this regenerated power. When this voltage is higher than an output voltage of the converter 2, the power supply from the three-phase AC power source 1 is stopped. When there is no power accumulating device 11 and this stopping state is continued, the voltage of the DC bus 3 is increased. Therefore, when a measuring voltage value of the voltage measuring instrument 18 for detecting the bus voltage of the DC bus 3 reaches a certain predetermined voltage, the regenerative control circuit 19 is operated and closes the gate 16 for regenerative current control. Thus, power flows through the regenerative resistor 17 and the regenerated power is consumed and the elevator is decelerated by electromagnetic braking effects. However, when there is the power accumulating device 11, this power is charged to the power accumulating device 11 by the control of the charging-discharging control circuit 15 with a voltage equal to or smaller than a predetermined voltage.

Namely, as shown in FIG. 13, if the measuring value of the bus voltage of the DC bus 3 provided by the voltage measuring instrument 18 exceeds the predetermined voltage, the charging-discharging control circuit 15 detects that it is a regenerative state, and increases a charging current to the secondary battery 12 by lengthening the ON pulse width of the gate 13*b* for charging current control (step S21→S22→S23). When the regenerated power from the elevator is reduced in a short time, the voltage of the DC bus 3 is also correspondingly reduced and no measuring value of the voltage measuring instrument 18 exceeds the predetermined voltage. Accordingly, the ON pulse width of the gate 13*b* for charging current control is shortly controlled and charging power is also reduced and controlled (step S21→S22→S24).

Thus, the bus voltage is controlled in a suitable range and a charging operation is performed by monitoring the bus voltage of the DC bus 3 and controlling the charging power. Further, energy is saved by accumulating and re-utilizing power conventionally consumed in the regenerated power.

For example, the power accumulating device 11 executes uniform charging of the secondary battery 12 once per one day in the nighttime, etc.

FIG. 14 is an explanatory view showing the uniform charging in which a charging current is shown on the ordinate and passing time is shown on the abscissa. Since this uniform charging requires a long time, the uniform charging is generally executed when traffic flow is small, such as in the nighttime, etc. The uniform charging utilizes a charging voltage that is raised together with an increase in a charging SOC (State of Charge), obtained by normalizing and accumulating a product of a charging-discharging current and a charging-discharging voltage, with a fully charged state of the power accumulating device 11 as a reference even when the secondary battery is charged by the same charging current. The secondary battery is charged by a constant current and charging until a terminal voltage for terminating this constant current charging is performed at stages shown in FIG. 14.

Namely, in the uniform charging, as shown in FIG. 14, the constant current charging is first executed by a charging current A1. The charging current is reduced to A2 after a time t1 at which the voltage of the secondary battery 12 is raised to a first terminal voltage although this time depends on a temperature, etc., during the charging. The charging is further executed. After a time t2 at which the voltage of the secondary battery 12 is raised until a second terminal voltage in the same current, the charging is performed slightly excessively by a low current for a constant time until a time t3.

A charging reception property of the secondary battery 12 is improved in this uniform charging. Further, when the secondary battery 12 includes plural batteries, the dispersion between the respective batteries is made uniform, etc. However, just after the uniform charging, excessive charging is performed by the uniform charging and the SOC level is high. Therefore, there is a bad influence of a reduction in energy saving effects such as a reduction in reception property of regenerative power of the elevator.

SUMMARY OF THE INVENTION

To solve the above problems, this invention provides a controller of an elevator for reducing the number of executing times of uniform charging and providing higher energy saving effects by monitoring a state of a power accumulating device. To achieve this object, a controller of an elevator in this invention comprises a converter for rectifying AC power. from an AC power source and converting the AC power to DC power; an inverter for converting the DC power from the converter to AC power of a variable voltage and a variable frequency and driving an electric motor and operating the elevator; a power accumulating device arranged between DC buses between the converter and the inverter, and accumulating DC power from the DC buses at a regenerative operation time of the elevator, and supplying the accumulated DC power to the DC buses at a power running operation time; charging-discharging control means for controlling charging and discharging operations of the power accumulating device with respect to the DC buses; and charging-discharging state measuring means for measuring at least one of a temperature, charging and discharging currents, and charging and discharging voltages of the power accumulating device; the controller being characterized in that the charging-discharging control means sets the execution of uniform charging of the power accumulating device on the basis of an output of the charging-discharging state measuring means.

Further, the charging-discharging control means has a table setting a judging voltage of the uniform charging with respect to the charging current of the power accumulating device, and calculates the judging voltage from the table on the basis of a measuring value of the charging current from the charging-discharging state measuring means, and sets the execution of the uniform charging of the power accumulating device on the basis of the comparison of a measuring value of the charging voltage from the charging-discharging state measuring means and the judging voltage.

Further, the charging-discharging control means has plural tables according to a charging degree as a value obtained by normalizing and accumulating a product of a charging-discharging current and a charging-discharging voltage by a capacity with a full charging state of the power accumulating device as a reference, and selects a table according to the charging degree.

Further, the charging-discharging control means has a table setting a changing amount of a judging voltage of the uniform charging with respect to the charging current of the power accumulating device, and calculates the changing amount of the judging voltage from the table on the basis of a measuring value of the charging current from the charging-discharging state measuring means, and sets the execution of the uniform charging of the power accumulating device on the basis of the comparison of a voltage changing amount of a measuring value of the charging voltage from the charging-discharging state measuring means and the changing amount of the judging voltage.

Further, the charging-discharging control means judges whether a running speed of the elevator is a constant speed or not on the basis of a command speed from speed control means for controlling the speed of the elevator, and sets the execution of the uniform charging of the power accumulating device on the basis of the comparison of the voltage changing amount of the measuring value of the charging voltage from the charging-discharging state measuring means and the changing amount of the judging voltage when it is judged that the running speed of the elevator is a constant speed.

Further, the charging-discharging control means accumulates an operating time of the elevator, and determines execution timing of the uniform charging of the power accumulating device when the uniform charging of the power accumulating device is set while the elevator is not operated, or when an accumulating time of the operating time of the elevator exceeds a set time while the elevator is not operated.

Further, the charging-discharging control means determines the execution timing of the uniform charging of the power accumulating device when a charging degree as a value obtained by normalizing and accumulating a product of a charging-discharging current and a charging-discharging voltage by a capacity on the basis of a measuring value from the charging-discharging state measuring means with a full charging state of said power accumulating device as a reference exceeds a predetermined value.

BRIEF DESCRIPTION OF THE DRAWINGS

FIG. 2 is an explanatory diagram of a table arranged in a speed control circuit in an embodiment 1 of this invention in which a judging voltage with respect to a charging current is set.

FIG. 4 is an explanatory diagram of plural tables arranged for every charging degree SOC in a speed control circuit in an embodiment 2 of this invention.

FIG. 6 is an explanatory diagram of a table arranged in a speed control circuit in an embodiment 3 of this invention in which a changing amount of a judging voltage with respect to a charging current is set.

DESCRIPTION OF THE PREFERRED EMBODIMENTS

This invention provides a controller of an elevator having a charging-discharging control device for reducing the number of uniform charging times and having high reliability and high energy saving effects by measuring an operating state of a power accumulating device and judging a period for executing the uniform charging.

The characteristics of a secondary battery arranged in the power accumulating device are different in accordance-with kinds of the battery such as a lead battery, a nickel hydrogen battery, etc. However, in general, when these characteristics are considered at the same temperature, a charging voltage at that time is increased as a charging current is increased. When a charging reception property becomes worse, the charging voltage tends to be notably increased when a large charging current particularly flows through the secondary battery. When this increase is detected, it is necessary to dissolve this tendency by executing the uniform charging. Such a problem is not notably caused when the uniform charging is once executed and the battery is then discharged in many cases and is again charged in the next nighttime as in an electric automobile. In the elevator, the number of uniform charging times is reduced as mentioned above to increase the energy saving effects. Accordingly, it is necessary to know the above tendency of the charging voltage.

Figure 1:
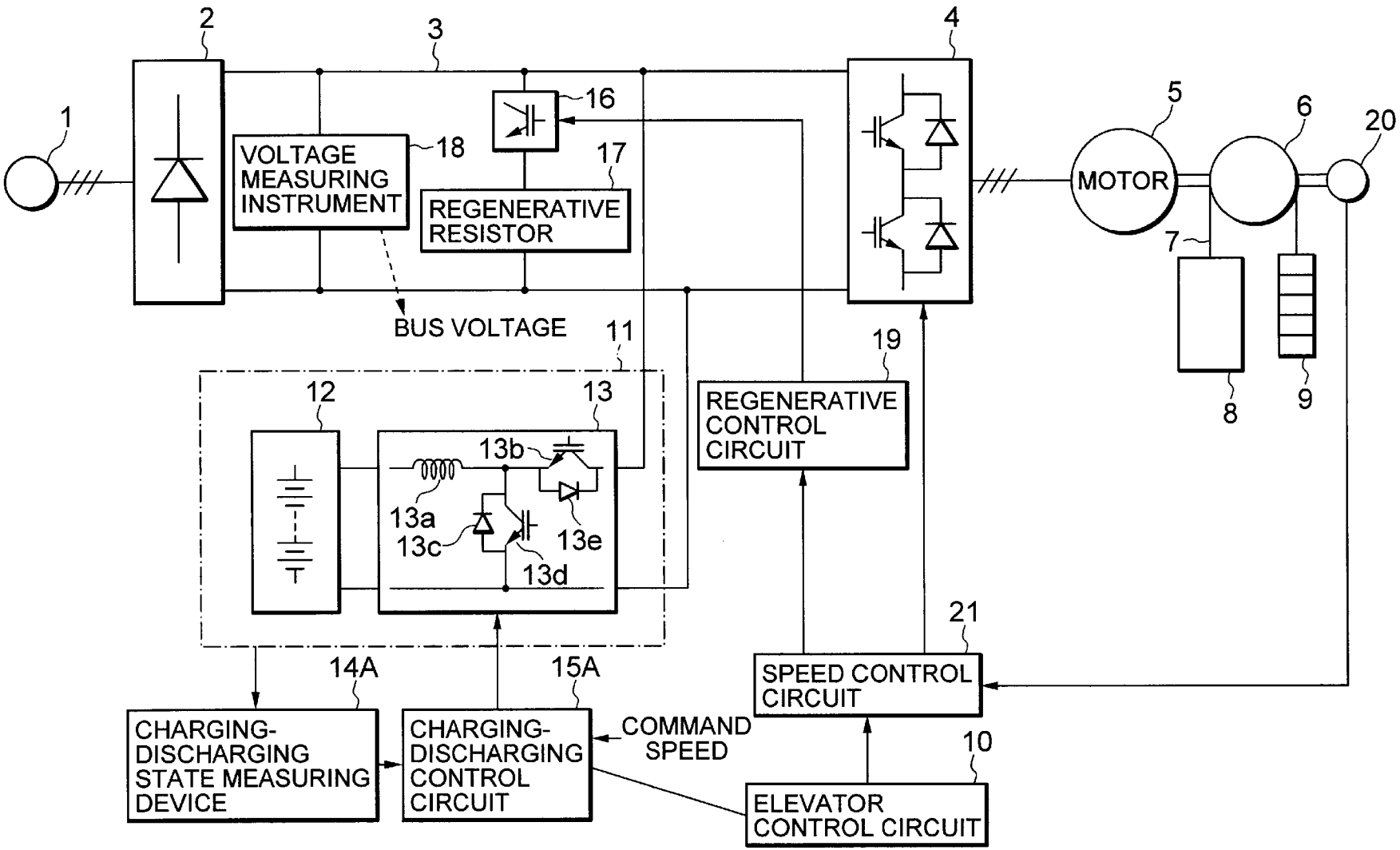
FIG. 1 is a block diagram showing the construction of a controller of an elevator in this invention.
Figure 11:
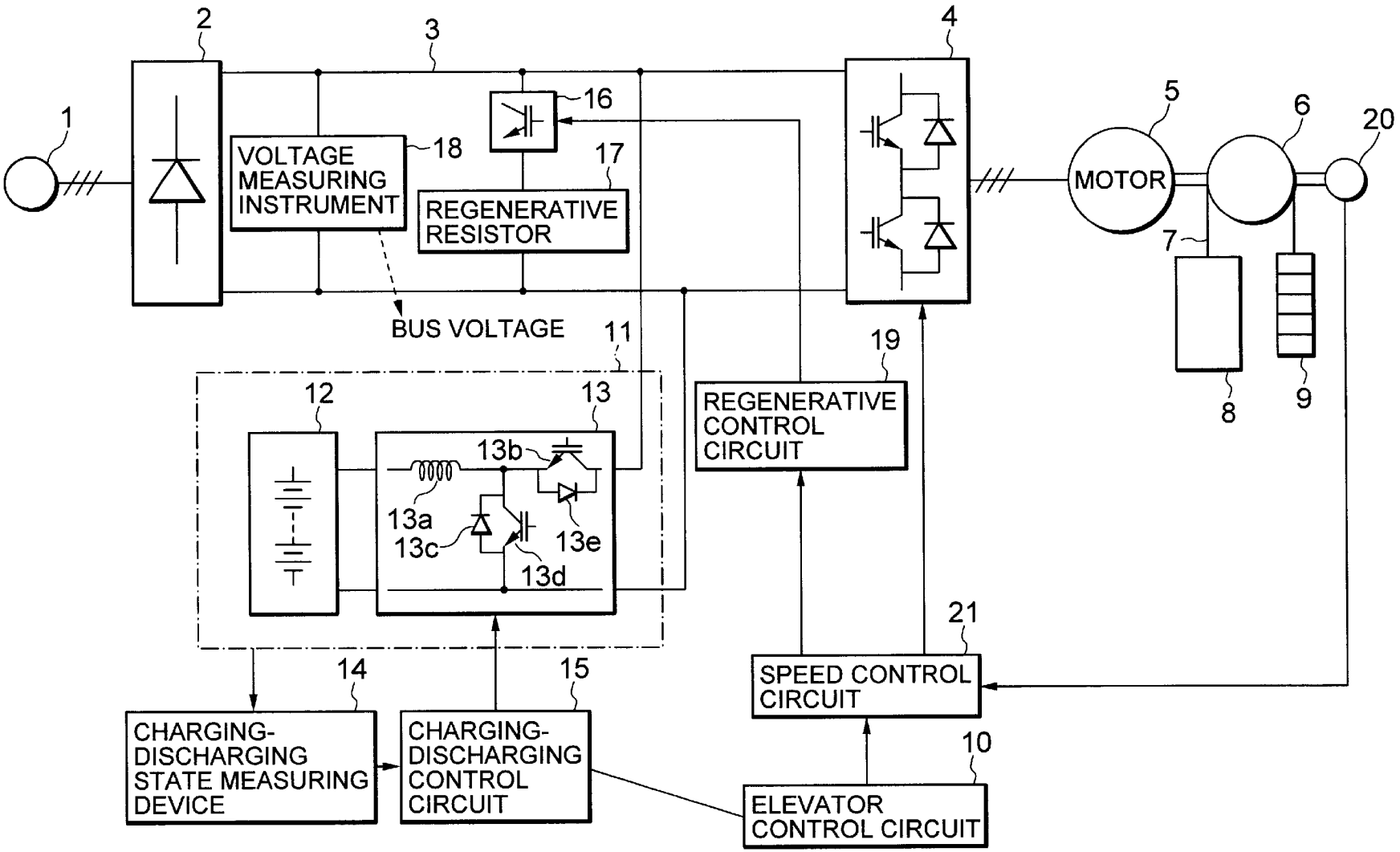
Figure 12:
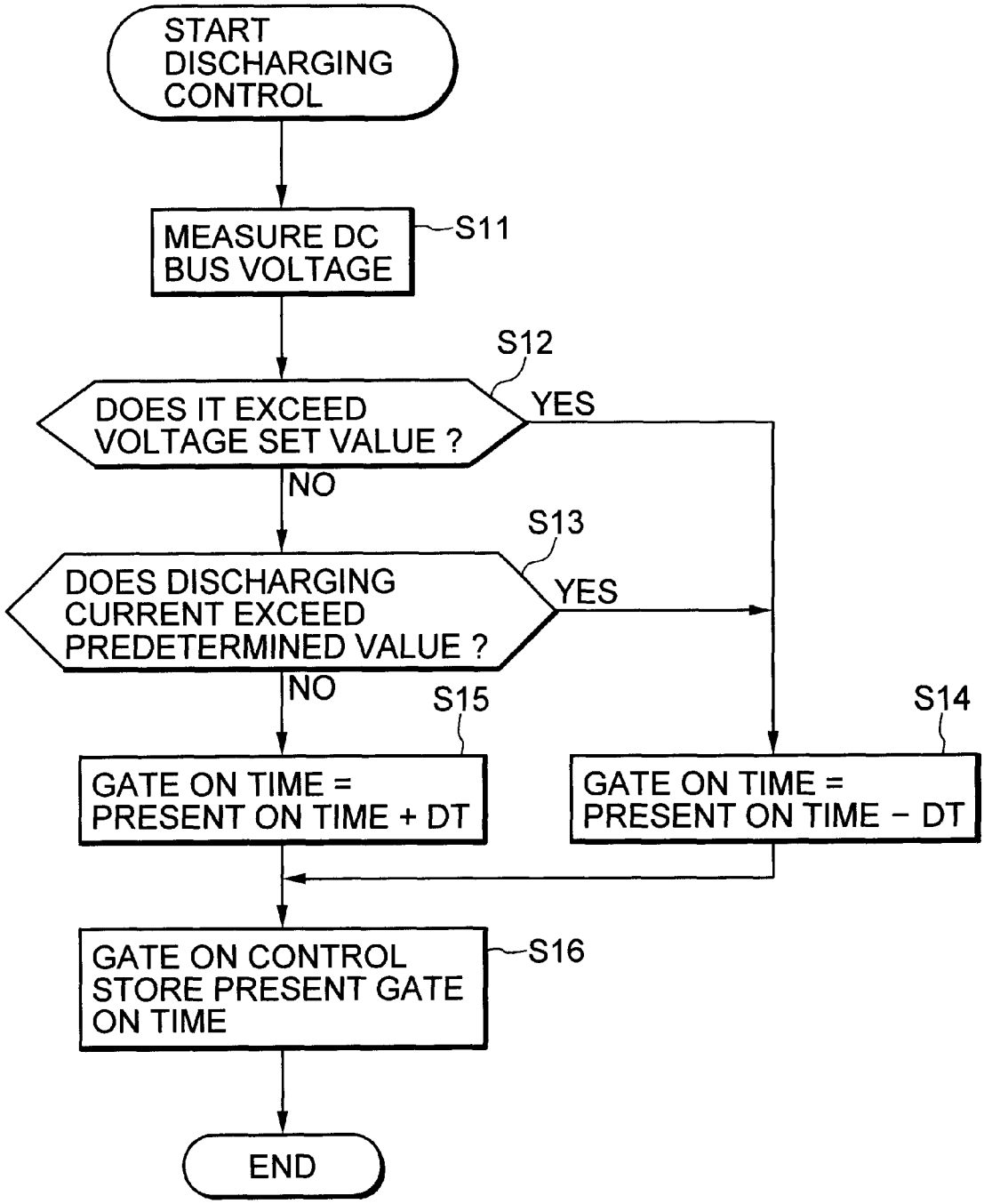
FIG. 12 is a flow chart showing the control of a charging-discharging control circuit shown in FIG. 11 during discharging.
Figure 13:
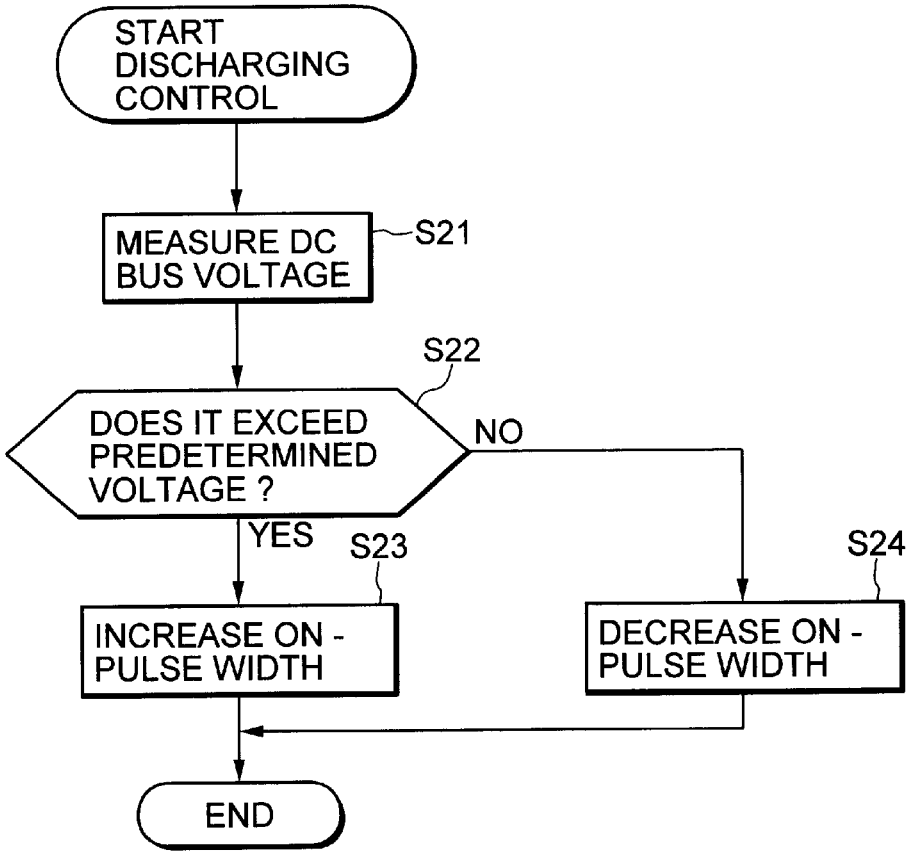
FIG. 13 is a flow chart showing the control of the charging-discharging control circuit shown in FIG. 11 during charging.
Figure 14:
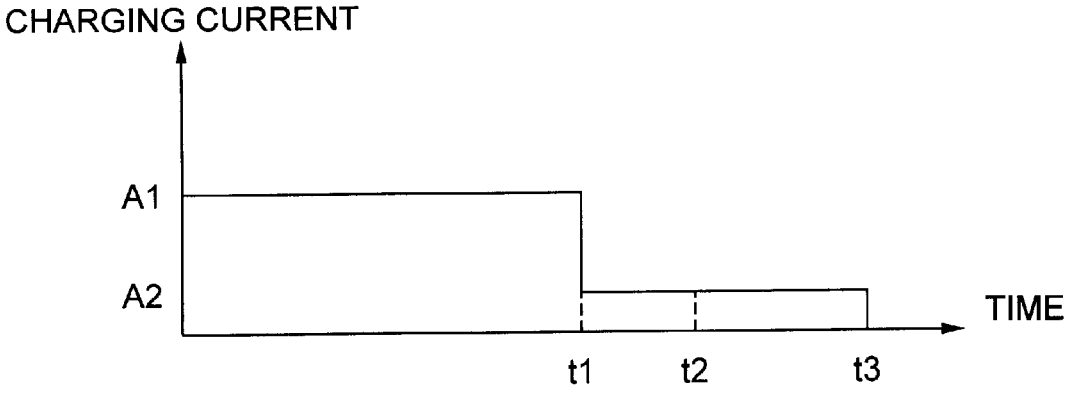
FIG. 14 is an explanatory diagram showing uniform charging.

FIG. 1 is a block diagram showing the construction of a controller of the elevator in this invention. In FIG. 1, the same portions as the conventional example shown in FIG. 11 are designated by the same reference numerals and their explanations are omitted here. New reference numerals 14A and 15A respectively designate a charging-discharging state measuring device and a charging-discharging control circuit in the present invention. The charging-discharging state measuring device 14A has each of measuring instruments for measuring charging and discharging currents, charging and discharging voltages and a temperature of a power accumulating device 11, and outputs each of these measuring values and a charging degree SOC to the charging-discharging control circuit 15A. The charging-discharging control circuit 15A controls charging and discharging operations of the power accumulating device 11 on the basis of a measuring value from the above charging-discharging state measuring device 14A and a command speed from a speed control circuit 21.

Concrete embodiments will next be explained.

Embodiment 1

In this embodiment mode 1, the charging-discharging control circuit 15A has a table T1 in which a judging voltage for judging the execution of uniform charging is set with respect to a charging current to a secondary battery 12 of the power accumulating device 11 as shown in FIG. 2. A measuring value of the charging current of the power accumulating device 11 is inputted from the charging-discharging state measuring device 14A to the charging-discharging control circuit 15A. The charging-discharging control circuit 15A calculates the judging voltage corresponding to a measuring value of the inputted charging current from the above table T1. Further, the charging-discharging control circuit 15A controls execution timing of the uniform charging by setting the execution of the uniform charging of the power accumulating device 11 on the basis of the comparison of a measuring value of the charging voltage from the above charging-discharging state measuring device 14A and the judging voltage.

Control of the charging-discharging control circuit 15A in the embodiment mode 1 of this invention will next be explained with reference to a flow chart shown in FIG. 3.

The charging-discharging control circuit 15A first judges whether charging is performed or not on the basis of a measuring value of the charging current from the charging-discharging state measuring device 14A at a charging time in a regenerative operation of the elevator (step S101). When the charging is performed, the charging-discharging control circuit 15A reads measuring values of the charging current and the charging voltage from the charging-discharging state measuring device 14A (step S102). The charging-discharging control circuit 15A also reads a judging voltage for judging the execution of uniform charging from the table T1 shown in FIG. 2 on the basis of the measuring value of the charging current (step S103).

The measuring value of the charging voltage is then compared with the judging voltage. When the measured charging voltage exceeds the judging voltage, it is judged that the uniform charging is required. Thus, the uniform charging is set and this setting is stored in a built-in memory, and the uniform charging is executed for a set time such as the nighttime. (steps S104, S105).

In the controller of the elevator constructed in this way, the uniform charging which reduces energy saving efficiency is executed only at a necessary time. Accordingly, the number of uniform charging times is reduced as a whole so that an elevator with the power accumulating device having higher energy saving efficiency can be constructed.

Embodiment Mode 2

Characteristics of the secondary battery 12 of the power accumulating device 11 are different in accordance with kinds of the battery such as a lead battery, a nickel hydrogen battery. However, in general, when these characteristics are considered at the same temperature and the secondary battery 12 is charged by the same charging current, the charging voltage of the battery at a charging time becomes a function of a charging degree SOC. Namely, the charging voltage is high in a high state of the charging degree SOC (in a state close to full charging). In contrast to this, the charging voltage is low in a low state of the charging degree SOC. In the elevator, the charging current provided by regenerative power is considerably greatly changed at a load state time of the elevator than the charging current used in the uniform charging. When a charging reception property of the secondary battery becomes worse, the charging voltage tends to be notably increased when particularly a large charging current flows through the secondary battery. Accordingly, when this increase is detected, it is necessary to dissolve this tendency by executing the uniform charging as mentioned above.

Figure 3:
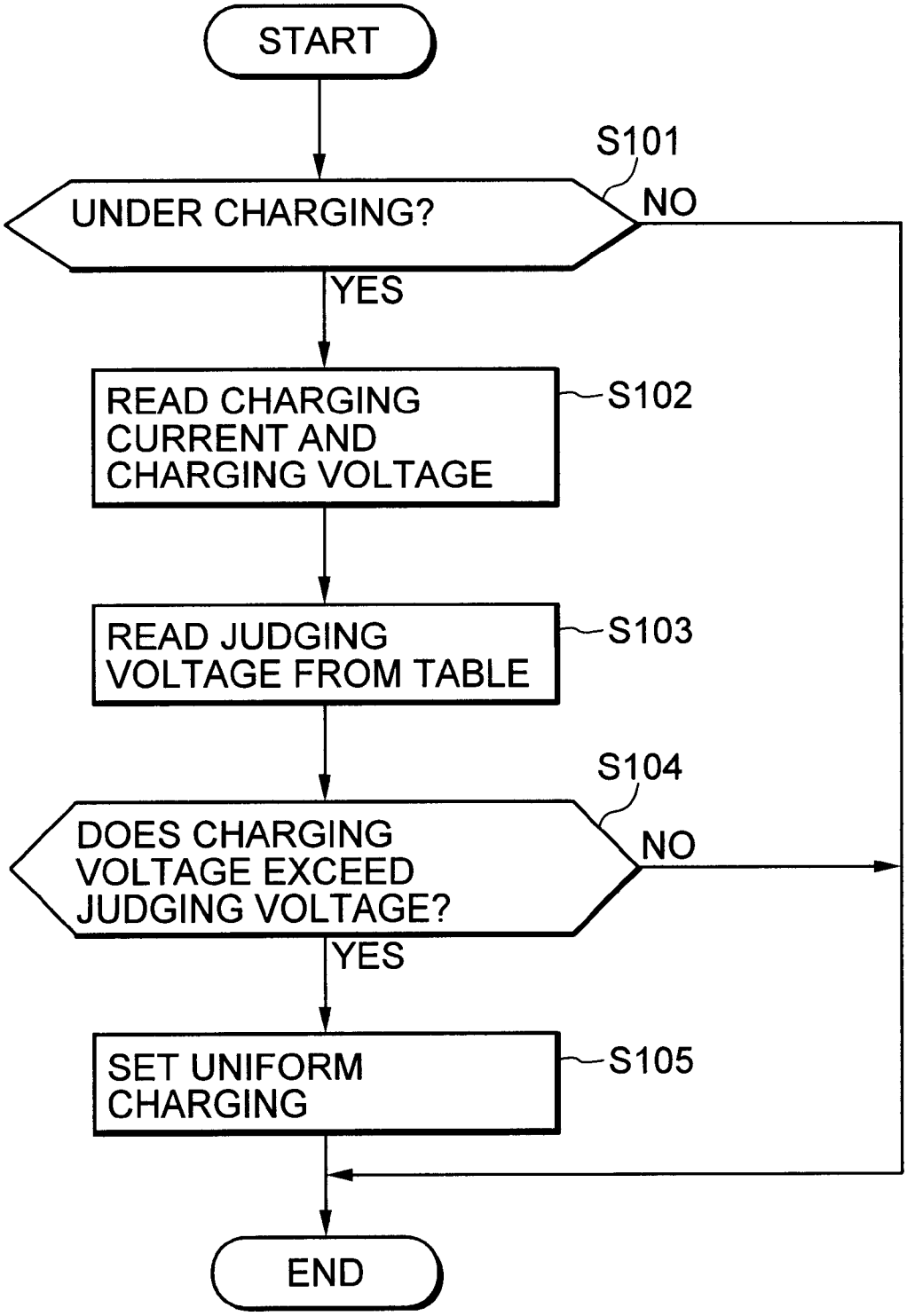
FIG. 3 is a flow chart showing control of the speed control circuit in the embodiment 1 of this invention.

In this embodiment mode 2, the charging-discharging control circuit 15A has plural tables T1*a*, T1*b*, . . . in which a judging voltage for judging the execution of the uniform charging is set with respect to the charging current to the secondary battery 12 of the power accumulating device 11 every charging degree SOC as shown in FIG. 3. The charging-discharging control circuit 15A selects a table according to the charging degree SOC as a value obtained by normalizing and accumulating a product of a charging-discharging current and a charging-discharging voltage by a capacity with a full charging state of the power accumulating device as a reference. Similar to the embodiment mode 1, the charging-discharging control circuit 15A calculates the judging voltage corresponding to a measuring value of the charging current from the selected table. The charging-discharging control circuit 15A then controls execution timing of the uniform charging by setting the execution of the uniform charging of the power accumulating device 11 on the basis of the comparison of a measuring value of the charging voltage from the charging-discharging state measuring device 14A and the judging voltage.

Control of the charging-discharging control circuit 15A in the embodiment mode 2 of this invention will next be explained with reference to a flow chart shown in FIG. 4.

The charging-discharging control circuit 15A first judges whether charging is performed or not on the basis of a measuring value of the charging current from the charging-discharging state measuring device 14A at a charging time in a regenerative operation of the elevator (step S201). When the charging is performed, the charging-discharging control circuit 15A reads measuring values of the charging current and the charging voltage from the charging-discharging state measuring device 14A, and also reads the present charging degree SOC by accumulating measuring values of the charging current, the charging voltage, a discharging current and a discharging voltage (step S202) (this charging degree SOC may be monitored by the charging-discharging control circuit 15A, but is monitored by the charging-discharging state measuring device 14A since the same effects are obtained).

The charging-discharging control circuit 15A then selects a table according to the present charging degree SOC from plural tables shown in FIG. 3, and reads a judging voltage for executing the uniform charging and corresponding to the measuring value of the charging current from the selected table (step S203). The measuring value of the charging voltage is then compared with the judging voltage. When it is judged that the measured charging voltage exceeds the judging voltage, it is judged that the uniform charging is required. Thus, the uniform charging is set and this setting is stored in a built-in memory and the uniform charging is executed for a set time such as the nighttime. (steps S204, S205).

Thus, if the charging degree SOC is used to judge the uniform charging, timing of the uniform charging can be more finely set. Further, the number of uniform charging times is reduced as a whole by executing the uniform charging which reduces energy saving efficiency only at a necessary time. Thus, an elevator with the power accumulating device having higher energy saving efficiency can be constructed.

Embodiment Mode 3

Figure 5:
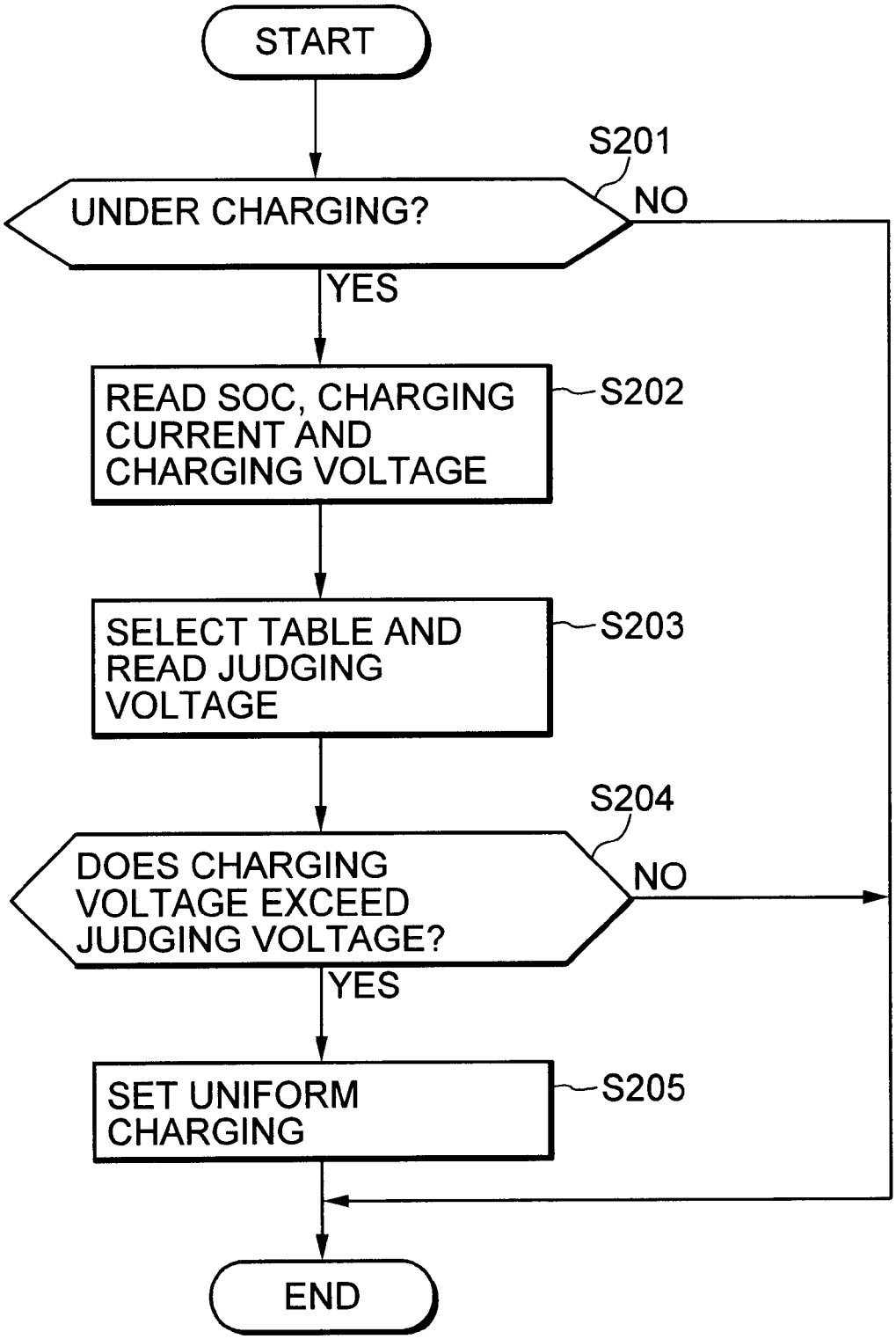
FIG. 5 is a flow chart showing control of the speed control circuit in the embodiment 2 of this invention.

In this embodiment mode 3, the charging-discharging control circuit 15A has a table T2 in which a changing amount of the judging voltage for judging the execution of the uniform charging is set with respect to the charging current to the secondary battery 12 of the power accumulating device 11 as shown in FIG. 5. The charging-discharging control circuit 15A calculates the changing amount of the judging voltage corresponding to a measuring value of the charging current from the table T2. The charging-discharging control circuit 15A then sets the execution of the uniform charging of the power accumulating device 11 on the basis of comparison of the changing amount of the judging voltage and a changing amount of a measuring value of the charging voltage from the charging-discharging state measuring device 14A with respect to the previous measuring value. Thus, the charging-discharging control circuit 15A controls execution timing of the uniform charging.

Control of the charging-discharging control circuit 15A in the embodiment mode 3 of this invention will next be explained with reference to a flow chart shown in FIG. 5.

The charging-discharging control circuit 15A first judges whether charging is performed or not on the basis of a measuring value of the charging current from the charging-discharging state measuring device 14A at a charging time in a regenerative operation of the elevator (step S301). When the charging is performed, the charging-discharging control circuit 15A reads the measuring value of the charging current from the charging-discharging state measuring device 14A, and also reads measuring values of the charging current and the charging voltage, and calculates a changing amount with respect to the charging voltage at a previous measuring time stored in a built-in memory (step S302). The charging-discharging control circuit 15A then reads a changing amount of the judging voltage for executing the uniform charging and corresponding to the measuring value of the present charging current from the table shown in FIG. 5 (step S303).

When the changing amount of the charging voltage and the changing amount of the judging voltage are compared and it is judged that the measured changing amount of the charging voltage exceeds the changing amount of the judging voltage, it is judged that the uniform charging is required. Thus, the uniform charging is set and this setting is stored in a built-in memory. The uniform charging is executed for a set time such as the nighttime, and the present charging voltage is stored in the built-in memory to prepare for the next measuring time (steps S304, S305).

Thus, the changing amount of the charging voltage is used to judge the uniform charging so that timing of the uniform charging can be more finely set. Further, the number of uniform charging times is reduced as a whole by executing the uniform charging which reduces energy saving efficiency only at a necessary time. Thus, an elevator with the power accumulating device having higher energy saving efficiency can be constructed.

Embodiment Mode 4

In this embodiment mode 4, similar to the embodiment mode 3, the charging-discharging control circuit 15A has a table T2 in which a changing amount of the judging voltage for judging the execution of the uniform charging is set with respect to the charging current to the secondary battery 12 of the power accumulating device 11 as shown in FIG. 5. The charging-discharging control circuit 15A calculates the changing amount of the judging voltage corresponding to a measuring value of the charging current from the table T2. The charging-discharging control circuit 15A then judges whether the elevator is operated or not at a constant speed on the basis of the input of a command speed from the speed control circuit 21. When the speed is judged as a constant speed, similar to the embodiment mode 3, the execution of the uniform charging of the power accumulating device 11 is set on the basis of the comparison of a changing amount of the charging voltage and the changing amount of the judging voltage. Thus, the charging-discharging control circuit 15A controls execution timing of the uniform charging.

Figure 7:
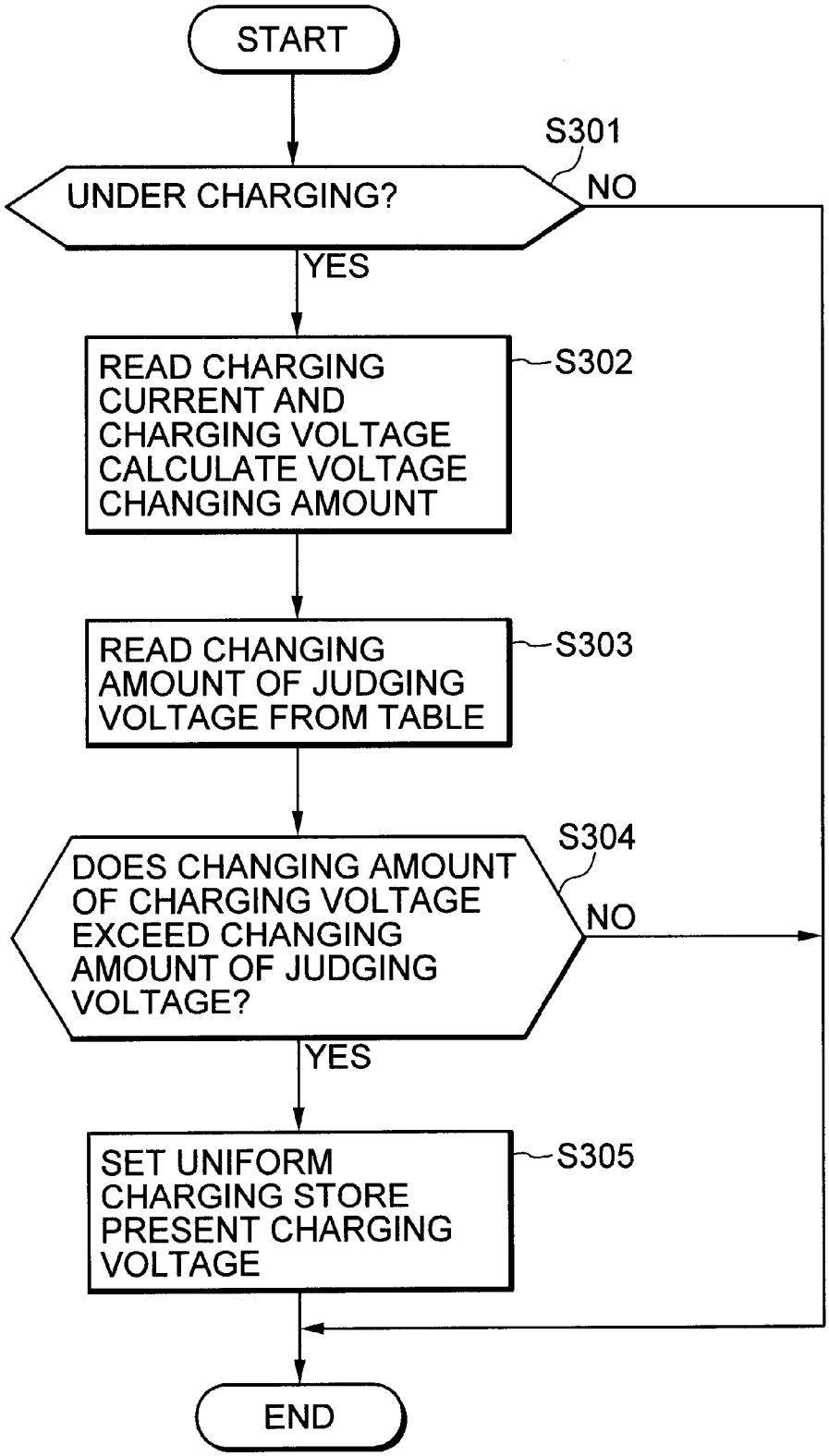
FIG. 7 is a flow chart showing control of the speed control circuit in the embodiment 3 of this invention.
Figure 8:
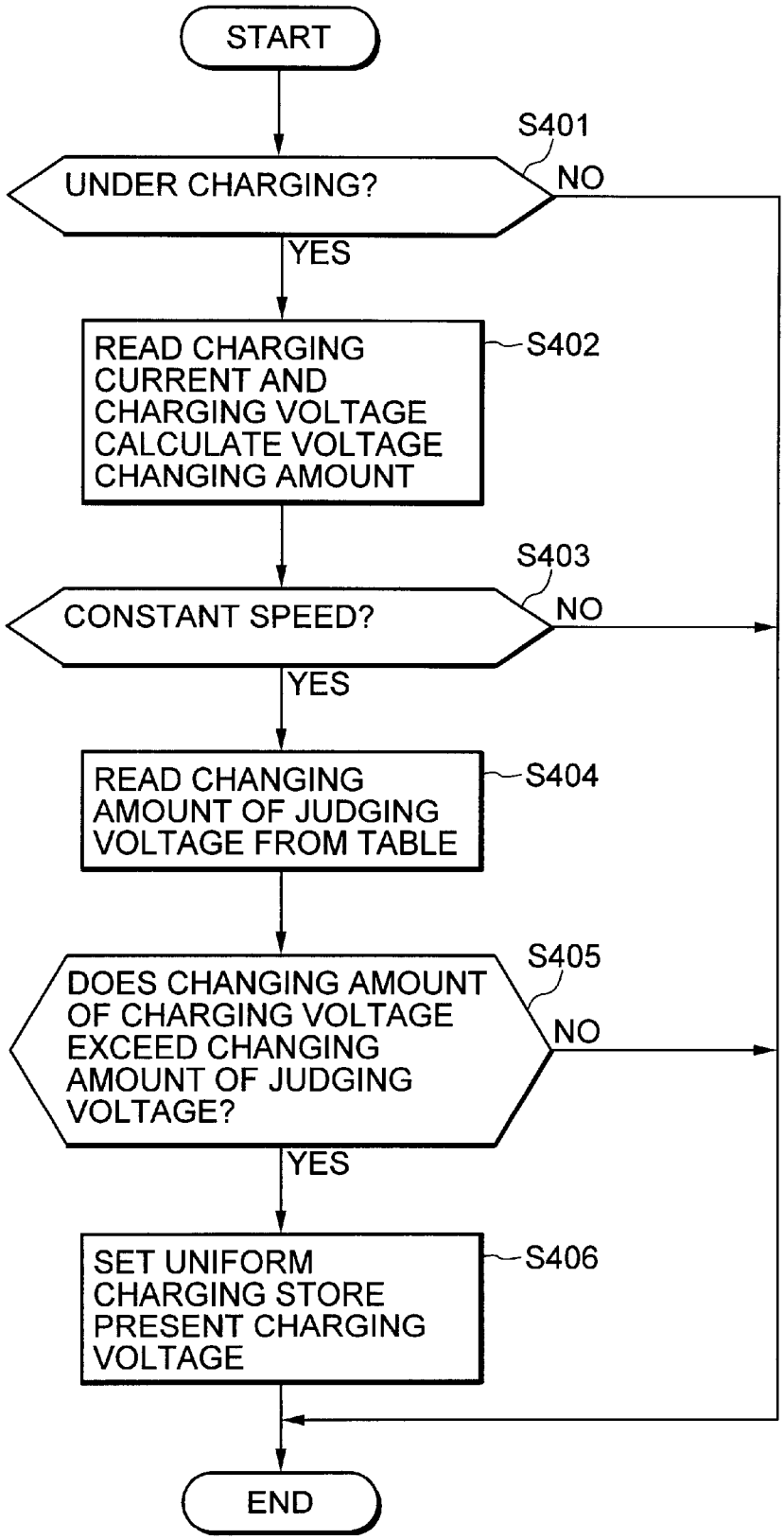
FIG. 8 is a flow chart showing the control of a speed control circuit in an embodiment 4 of this invention.

Control of the charging-discharging control circuit 15A in the embodiment mode 4 of this invention will next be explained with reference to a flow chart shown in FIG. 7.

The charging-discharging control circuit 15A first judges whether charging is performed or not on the basis of a measuring value of the charging current from the charging-discharging state measuring device 14A at a charging time in a regenerative operation of the elevator (step S401). When the charging is performed, the charging-discharging control circuit 15A reads the measuring value of the charging current from the charging-discharging state measuring device 14A, and also reads measuring values of the charging current and the charging voltage, and calculates a changing amount with respect to the charging voltage at a previous measuring time stored in a built-in memory (step S402).

The charging-discharging control circuit 15A then judges whether the elevator is operated or not at a constant speed on the basis of a change in command speed outputted from the speed control circuit 21 (step S403). If the speed is a constant speed, the charging-discharging control circuit 15A reads a changing amount of the judging voltage for executing the uniform charging and corresponding to the measuring value of the present charging current from the table shown in FIG. 5 (steps S403, S404). The charging-discharging control circuit 15A then compares the changing amount of the charging voltage and the changing amount of the judging voltage. When it is judged that the measured changing amount of the charging voltage exceeds the changing amount of the judging voltage, it is judged that the uniform charging is required. Thus, the uniform charging is set and this setting is stored in the built-in memory, and the uniform charging is executed for a set time such as the nighttime, and the present charging voltage is stored in the built-in memory to prepare for the next measuring time (steps S405, S406).

Thus, the constant speed of the elevator is detected and the changing amount of the charging voltage is used to judge the uniform charging so that timing of the uniform charging can be more finely set. Further, the number of uniform charging times is reduced as a whole by executing the uniform charging which reduces energy saving efficiency only at a necessary time. Thus, an elevator with the power accumulating device having higher energy saving efficiency can be constructed.

Embodiment Mode 5

Figure 9:
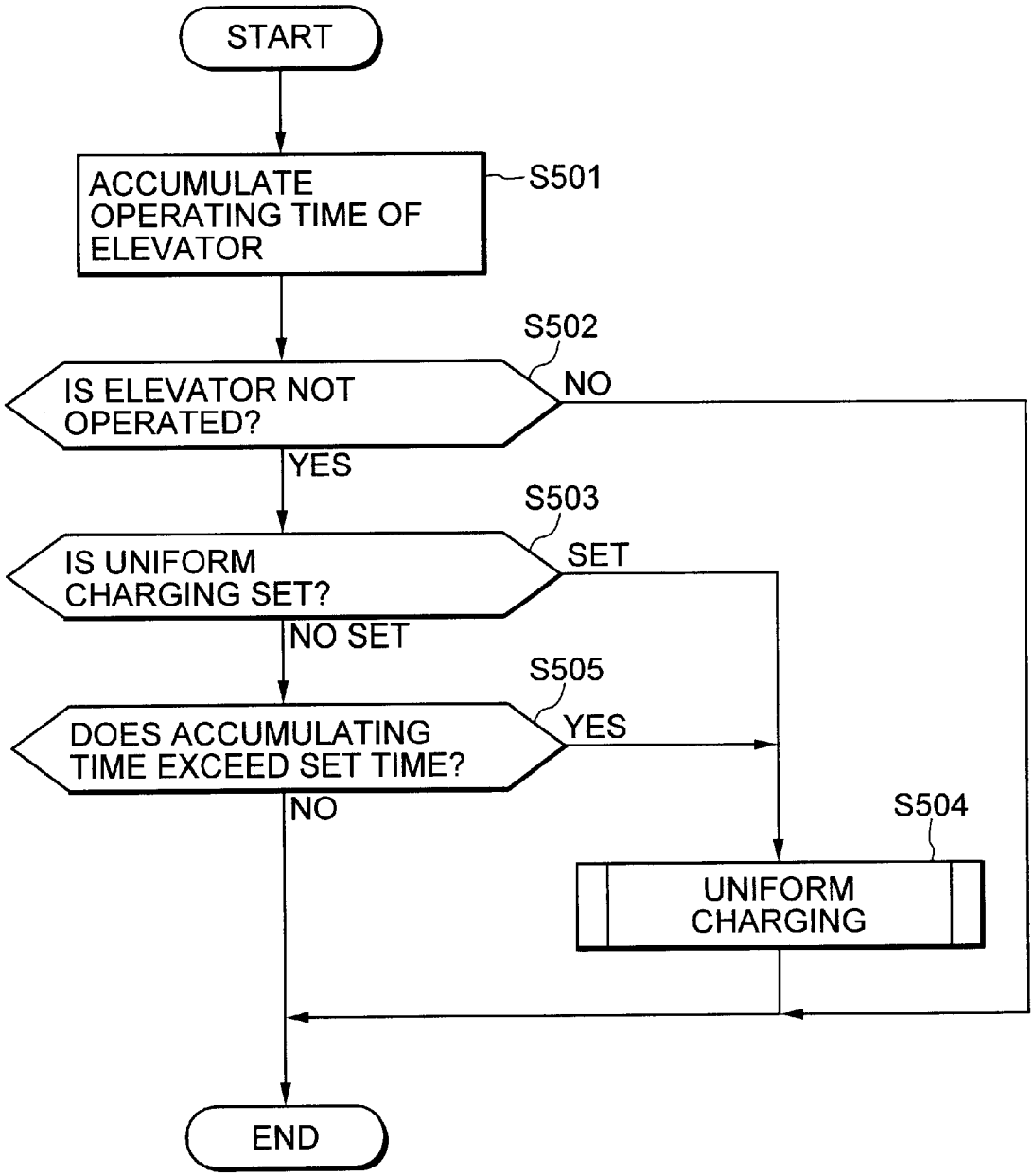
FIG. 9 is a flow chart showing the control of a speed control circuit in an embodiment 5 of this invention.

FIG. 9 is a flow chart showing control contents for executing the uniform charging of the charging-discharging control circuit 15A in the embodiment mode 5 of this invention.

Control of execution timing of the uniform charging in the charging-discharging control circuit 15A will next be explained in accordance with the flow chart shown in FIG. 9.

The charging-discharging control circuit 15A first accumulates an operating time of the elevator (step S501). For example, this operating time is accumulated by counting a sending-out period of a command speed from the speed control circuit 21. Next, for example, it is judged whether the elevator is out of operation or not by judging whether or not the command speed is outputted from the speed control circuit 21 (step S502).

If the elevator is out of operation, it is judged whether the uniform charging is set or not as in setting processings of the uniform charging shown in the above embodiment modes 1 to 4. If the uniform charging is set, the uniform charging is immediately executed (steps S503, S504). In contrast to this, if no uniform charging is set, the accumulated operating time calculated in the step S501 is compared with a set time. When the accumulated operating time exceeds the set time, the uniform charging is executed (step S503→S505).

Thus, the uniform charging is executed on the basis of the accumulated operating time of the elevator and existence of setting of the uniform charging. The number of uniform charging times is reduced as a whole by executing the uniform charging which reduces energy saving efficiency only at a necessary time. Thus, an elevator with the power accumulating device having higher energy saving efficiency can be constructed.

Embodiment Mode 6

Figure 10:
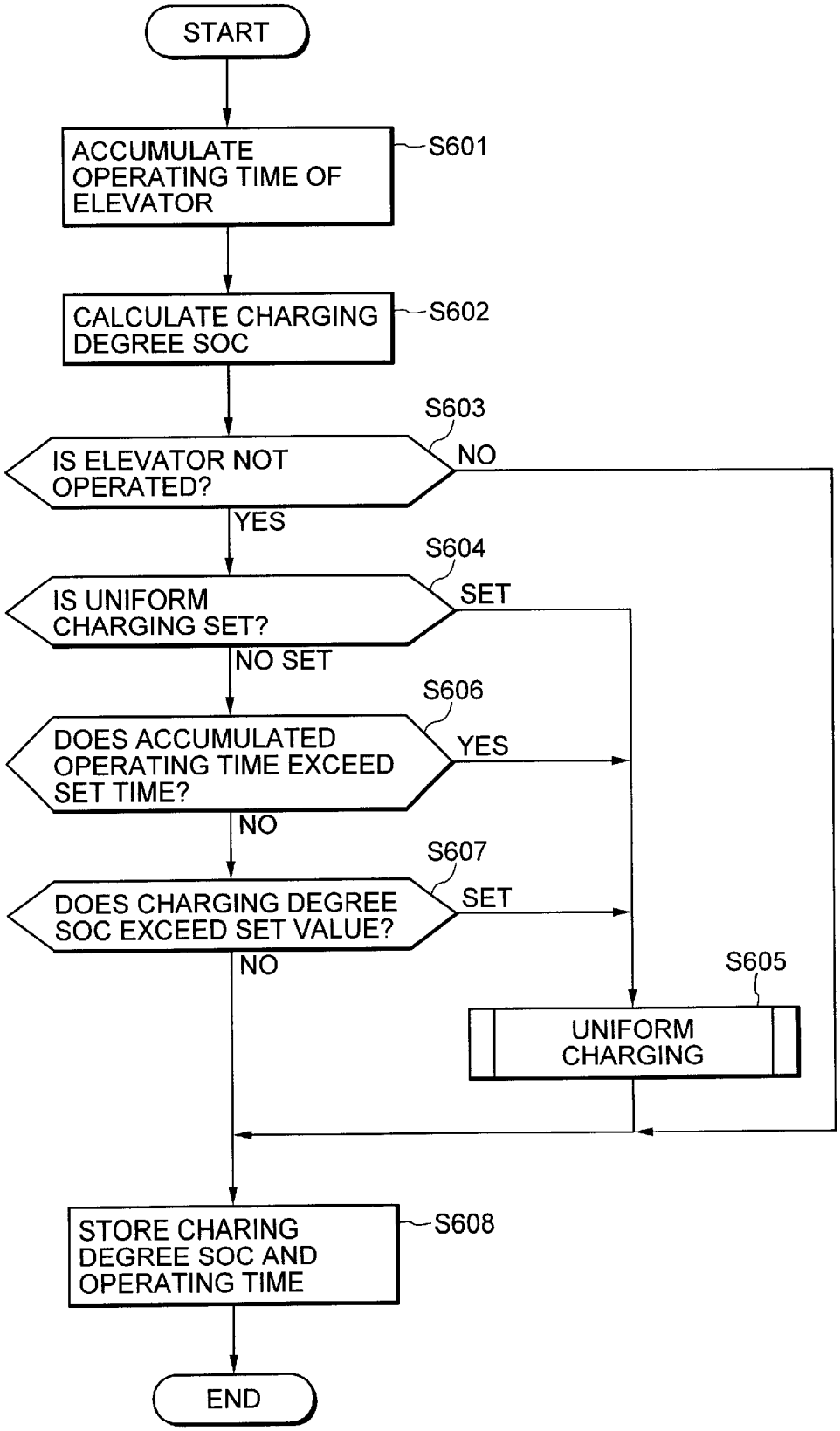
FIG. 10 is a flow chart showing the control of a speed control circuit in an embodiment 6 of this invention.

FIG. 10 is a flow chart showing control contents for executing the uniform charging of the charging-discharging control circuit 15A in an embodiment mode 6 of this invention.

Control of execution timing of the uniform charging in the charging-discharging control circuit 15A will next be explained in accordance with the flow chart shown in FIG. 10.

The charging-discharging control circuit 15A accumulates an operating time of the elevator (step S601). For example, this operating time is accumulated by counting a sending-out period of a command speed from the speed control circuit 21. The charging-discharging control circuit 15A also calculates a charging degree SOC from the charging-discharging state measuring device 14A (step S602). Next, for example, it is judged whether the elevator is out of operation or not by judging whether or not the command speed is outputted from the speed control circuit 21 (step S603).

If the elevator is out of operation, it is judged whether the uniform charging is set or not as in setting processings of the uniform charging shown in the above embodiment modes 1 to 4. If the uniform charging is set, the uniform charging is immediately executed (steps S604, S605). In contrast to this, if no uniform charging is set, the accumulated operating time calculated in the step S501 is compared with a set time. When the accumulated operating time exceeds the set time, the uniform charging is executed (step S604→S606). The uniform charging is also executed when no accumulated operating time exceeds the set time but the charging degree SOC calculated in the above step S602 exceeds a set value (steps S606, S607). After processing of the uniform charging, the charging degree SOC and the accumulated operating time are stored in a built-in memory to prepare for the next control, and it is terminated (step S608).

Thus, the uniform charging is executed on the basis of the accumulated operating time of the elevator, the charging degree SOC and existence of setting of the uniform charging. The number of uniform charging times is reduced as a whole by executing the uniform charging which reduces energy saving efficiency only at a necessary time. Thus, an elevator with the power accumulating device having higher energy saving efficiency can be constructed.

As mentioned above, in accordance with this invention, it is possible to construct an elevator with a power accumulating device having larger energy saving effects by executing only required uniform charging.

What is claimed:

1. A controller for scheduling constant-current charging of a rechargeable power source of an elevator system, the controller comprising:

a converter for rectifying AC power from an AC power source to produce DC power;

an inverter for converting DC power into AC power having a variable voltage and a variable frequency for driving an electric motor operating an elevator;

DC buses connecting said converter to said inverter;

a rechargeable power accumulating device connected across said DC buses, accumulating DC power from the DC buses during regenerative operation of the electric motor, and supplying accumulated DC power to the DC buses during powered operation of the electric motor;

charging-discharging control means for controlling charging and discharging of said power accumulating device with respect to the DC buses; and charging-discharging state measuring means for measuring at least one of temperature, charging and discharging currents, and charging and discharging voltages of said power accumulating device, wherein said charging-discharging control means schedules constant-current charging of said power accumulating device based on at least one measurement by said charging-discharging state measuring means that indicates deteriorated charging characteristics of said power accumulating device.

2. The controller of an elevator according to claim 1, wherein said charging-discharging control means has a table storing judging voltages with respect to corresponding charging currents of said power accumulating device, and identifies a judging voltage from the table based on a charging current measured by said charging-discharging state measuring means during regenerative operation of the electric motor, and schedules constant-current charging of said power accumulating device based on a comparison of the charging voltage measured by said charging-discharging state measuring means and the judging voltage identified for the corresponding charging current.

3. The controller of an elevator according to claim 2, wherein said charging-discharging control means has plural tables storing a charging degree of said power accumulating device, obtained by normalizing and accumulating products of charging-discharging currents and corresponding charging-discharging voltages of said power accumulating device, using a fully charged state of said power accumulating device as a reference, and selects a table for identifying a judging voltage according to the charging degree calculated from measurements made by said charging-discharging measuring means.

4. The controller of an elevator according to claim 1, wherein said charging-discharging control means has a table determining a change of judging voltage with respect to charging current of said power accumulating device, calculates a change of the judging voltage from the table based on charging currents measured by said charging-discharging state measuring means, and schedules the constant-current charging of said power accumulating device based on comparison of a voltage change of the charging voltage measured by said charging-discharging state measuring means and the change of the judging voltage calculated from the table.

5. The controller of an elevator according to claim 4, including speed control means for controlling speed of the elevator and wherein said charging-discharging control means determines whether the speed of the elevator is constant based on a command speed from said speed control means, and, when the speed of the elevator is constant, controls scheduling of the constant-current charging of said power accumulating device based on comparison of the voltage change of the charging voltage measured by said charging-discharging state measuring means and the change of the judging voltage calculated from the table.

6. The controller of an elevator according to claim 1, wherein said charging-discharging control means accumulates operating time of the elevator, and determines timing of the constant-current charging of said power accumulating device for a time when the elevator is not operated and when the operating time accumulated exceeds a set time.

7. The controller of an elevator according to claim 6, wherein said charging-discharging control means determines timing of the constant-current charging of said power accumulating device when a charging degree, obtained by normalizing and accumulating products of charging-discharging current and charging-discharging voltage relative to a capacity based on values measured by said charging-discharging state measuring means, with a fully charged state of said power accumulating device as a reference, exceeds a predetermined value.

* * * * *